US005774958A

United States Patent [19]

Casimir

[11] Patent Number: 5,774,958

[45] Date of Patent: Jul. 7, 1998

[54] DISSOLVABLE URN

[76] Inventor: Douglas M. Casimir, 182 Old Field Rd., Setauket, N.Y. 11733

[21] Appl. No.: 682,445

[22] Filed: Jul. 17, 1996

Related U.S. Application Data

[63] Continuation of Ser. No. 348,464, Dec. 2, 1994, abandoned.

[51] Int. Cl.[6] ..... A61G 17/08

[52] U.S. Cl. ..... 27/1

[58] Field of Search ..... 27/1, 2, 3, 35

[56] References Cited

U.S. PATENT DOCUMENTS 3,732,602 5/1973 Vigh ..... 27/1
5,389,767 2/1995 Dobry ..... 219/730

FOREIGN PATENT DOCUMENTS 4204404 8/1993 Germany ..... 27/1
3021888 11/1993 WIPO ..... 27/1
4023685 10/1994 WIPO ..... 27/1

*Primary Examiner*—Kien T. Nguyen
*Attorney, Agent, or Firm*—Galgano & Burke

[57] ABSTRACT

A dissolvable urn for the disposal of cremated remains. The urn is constructed of material which will dissolve when immersed in either water or salt water. This will prevent the urn from later washing ashore. The urn may be designed with sufficient mass and density so that it will sink upon being cast into the water so as to further reduce the possibility of the urn washing ashore. The urn may also be designed so that it is light enough to float and dissolves rapidly enough so that onlookers may observe the urn dissolving and the ashes spreading out upon the water without the necessity of opening the urn and sprinkling the ashes upon the water.

2 Claims, 1 Drawing Sheet

DISSOLVABLE URN

This application is a continuation of application Ser. No. 08/348,464 filed Dec. 2, 1994 now abandoned.

FIELD OF THE INVENTION

This invention generally relates to urns used for burying the remains of humans and animals and more particularly to a dissolvable urn for disposing of the cremated remains of a deceased person or animal at sea or in some other large body of water.

BACKGROUND OF THE INVENTION

Cremation is used extensively today as an alternative to burial or entombment of a deceased person or animal. The cremation remains, also commonly referred to as the cremation ashes or cremains are placed in an urn after cremation of the body has taken place. The ashes are either then permanently stored in said urn and buried, or the urn is often taken out to sea and thrown overboard or opened and the ashes are sprinkled upon the sea. Often, when the entire urn containing the cremated ashes is thrown overboard, the urn will float and eventually wash ashore. An urn which is washed ashore is often returned by the finder either to the funeral home or to the deceased's relatives, thereby causing further grief to the said deceased's relatives. When the urn is opened and ashes are sprinkled upon the sea, the wind often causes the ashes to blow about and the ashes sometimes get blown upon the deceased's relatives who are sprinkling the ashes, thereby causing an unpleasant experience for those involved.

The present device differs from those previously known in that the present device will dissolve when immersed in water (e.g. thrown into the sea) and therefore will not wash ashore several days later. This will also allow people who want to spread their deceased loved one's ashes upon the water to throw the entire urn into the sea and watch it float and dissolve without the necessity of opening the urn and pouring the ashes out. The present device may also be made of a sufficient density and weight so that it will sink upon being cast into the sea, thereby further reducing the possibility it will wash ashore.

SUMMARY OF THE INVENTION

The dissolvable urn for the burial of cremated remains of the present invention overcomes the aforementioned problems encountered by the prior art as it may be made of a material which will dissolve when it is immersed in either water or salt water. The material of which the urn is constructed may be chosen so that it will either dissolve very rapidly so that the deceased's relatives may observe the dissolving of the urn and the resultant scattering of the ashes in the water, or so that the urn will dissolve more slowly thereby dissolving after the decedent's loved ones have left the ceremony and returned to shore, but prior to the urn washing ashore.

The urn of the present invention may be made in the shape of any standard urn. For example, the urn may be in the shape of a vase, cube or sculpture as is commonly done with prior art urns. The urn of the present invention can be made out of two (2) pieces, a container having a cavity or chamber therein capable of holding the cremated remains (approximately greater than 220 cubic inches for adults) and a lid capable of being secured to the container so as to seal and close the container to prevent the spillage of cremation remains from the urn. The lid may be affixed to the container by any common means such as gluing, cementing or other adhesive means, or by either screwing the lid onto the container or clamping or other common means.

The dissolvable urn of the present invention may also be made so as to have a light enough mass and density so that the urn will float when tossed into a lake or ocean so that the decedent's loved ones may watch it dissolve. The dissolvable urn of the present invention may also be made with a great enough mass and density so that it will sink upon being thrown into a lake or ocean thereby further reducing the possibility said urn will float ashore.

The materials from which the dissolvable urn of the present invention is made are preferably all environmentally safe so that they will not pollute the environment. Some examples of materials which may be used to construct the present invention are unfired ceramic clays, heat treated sodium bicarbonate, solid sodium chloride and solid calcium chloride. Of course, there are many other materials from which the dissolvable urn of the present invention may be constructed, including any material which will dissolve upon being immersed in water and/or salt water.

Another object of our invention is to provide for an urn which will sink when thrown into a lake, ocean, or other body of water. This is accomplished by using materials having a sufficient density and mass in relation to the overall total volume of the urn so that the urn, even when only partially filled with cremated remains and air, will have a specific gravity greater than water and/or salt water. This is necessary because not all deceased people and animals are the same size and therefore they produce varying volumes of cremated ashes. The urns therefore, often have some air space, in addition to the ashes, inside of them when they are sealed.

It is a further object of our invention to provide for a dissolvable urn which is sufficiently light enough so it will not sink when thrown into a lake, ocean, or other body of water. This is so that the urn will dissolve while floating at the surface, so that the deceased's loved ones may observe the scattering of the ashes across the water without the necessity of opening the urn and sprinkling the ashes and exposing the ashes to the wind which may blow them back into the face of the deceased's loved ones. In this embodiment, the urn may be made out of materials which will dissolve more rapidly (e.g. an unfired clay) so that onlookers will not have to wait for very long for the urn to completely dissolve.

Yet another object of this invention is to provide for a dissolvable urn which will dissolve sufficiently slow enough so that it will not dissolve in the presence of the decedent's loved ones when they throw it into a lake, ocean, or other body of water, but will still dissolve quickly enough so that it will not be possible for the urn to wash ashore.

DETAILED DESCRIPTION OF THE INVENTION

Figure 1:
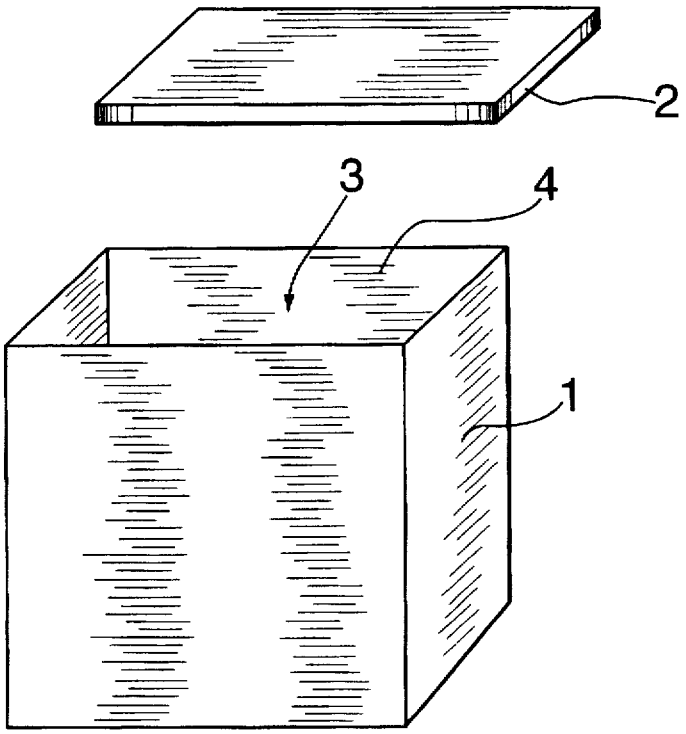
FIG. 1 is a plain view of one of the embodiments of the present invention.

Referring to FIG. 1 of the drawings, one preferred embodiment comprises a container 1 having a chamber 3 and opening 4 formed therein, with the chamber 3 being formed so as to be capable of holding the cremated remains of human being or animal. The container 1 has an opening 4 formed therein so that cremated remains may be inserted into the chamber 3 from the exterior of the container 1. A lid 2 is provided which is capable of being affixed to the container 1 by adhesive means so as to seal and close the opening 4 once cremated remains have been placed in the chamber 3.

The container 1 and the lid 2 are made of a dissolvable material which will dissolve when immersed in fresh water or salt water. This dissolvable material is preferably an unfired ceramic clay but may also be heat-treated sodium bichloride, solid sodium chloride, solid calcium chloride or any other material which will dissolve.

The container 1 and the lid 2 are also designed so that they have a sufficient mass so that whether the urn is completely filled or only partially filled with cremated remains, and is sealed, that the urn will still sink when thrown into either fresh water or salt water.

In another embodiment of the present invention the dissolvable urn is made of a material which will dissolve rapidly enough so that onlookers may observe the urn dissolving while they watch and therefore watch the scattering of the ashes amongst the water. In this embodiment the container 1 and lid 2 would be constructed so that the urn, even when completely filled with cremation remains, would not sink in either water or salt water so that it will float at the surface while the onlookers observe it dissolving.

What is claimed is:

1. A dissolvable urn for burial of cremated remains in water, said dissolvable urn comprising:

a container having a cavity and an opening formed therein, said cavity being capable of holding cremated remains and said opening being capable of allowing cremated remains to be placed into the cavity from the outside; and a lid capable of being affixed to the container to seal said opening therein;

wherein said container and said lid comprise a material selected from the group consisting of clay, heat treated sodium bicarbonate, solid sodium chloride, solid calcium chloride and a combination thereof, said container and said lid being dissolvable within several days when immersed in water, and said urn being configured to have a specific gravity less than water so that said urn will initially float when immersed in water and dissolve while floating.

2. A dissolvable urn for burial of cremated remains in water, said dissolvable urn comprising:

a container having a cavity and an opening formed therein, said cavity being capable of holding cremated remains and said opening being capable of allowing cremated remains to be placed into the cavity from the outside, and a lid capable of being affixed to the container to seal said opening therein;

wherein said container and said lid comprise a material selected from the group consisting of clay, heat treated sodium bicarbonate, solid sodium chloride, solid calcium chloride and a combination thereof, said container and said lid being dissolvable within several days when immersed in water, and said urn being configured to have a specific gravity greater than water so that said urn will sink when immersed in water.

* * * * *